United States Patent [19]

Hoke

[11] 4,209,408

[45] Jun. 24, 1980

[54] LUBRICANTS AND FUNCTIONAL FLUIDS CONTAINING β-THIOPROPIONITRILES AND SIMILAR POLYFUNCTIONAL NITRILES

[75] Inventor: Donald I. Hoke, Chagrin Falls, Ohio

[73] Assignee: The Lubrizol Corporation, Wickliffe, Ohio

[21] Appl. No.: 794,498

[22] Filed: May 6, 1977

Related U.S. Application Data

[63] Continuation-in-part of Ser. No. 637,920, Dec. 5, 1975, Pat. No. 4,058,469.

[51] Int. Cl.[2] ..... C10M 1/38

[52] U.S. Cl. ..... 252/47; 252/47.5

[58] Field of Search ..... 252/47, 47.5, 72

[56] References Cited

U.S. PATENT DOCUMENTS

| | | | |
|---|---|---|---|
| 2,310,670 | 2/1943 | Badertscher et al. | 252/47 |
| 2,362,890 | 11/1944 | Dietrich | 252/47 |
| 2,587,661 | 3/1952 | Smith | 252/47 X |
| 2,630,452 | 3/1953 | Crouch et al. | 252/47 X |
| 3,984,336 | 10/1976 | Cier et al. | 252/47 X |
| 4,058,469 | 11/1977 | Hoke | 252/51.5 R |

*Primary Examiner*—Andrew Metz

*Attorney, Agent, or Firm*—Daniel N. Hall; William H. Pittman; Raymond F. Keller

[57] ABSTRACT

Compositions useful as lubricants and functional fluids comprise an oleaginous liquid of lubricating viscosity, typically a mineral oil, and a sulfur-containing polyfunctional nitrile. The preferred nitriles are cyanoethylation products of mercaptans. They serve as seal swelling agents and/or demulsifiers.

27 Claims, No Drawings

LUBRICANTS AND FUNCTIONAL FLUIDS CONTAINING β-THIOPROPIONITRILES AND SIMILAR POLYFUNCTIONAL NITRILES

This application is a continuation-in-part of copending application Ser. No. 637,920, filed Dec. 5, 1975, now U.S. Pat. No. 4,058,469.

This invention relates to new compositions of matter useful as functional fluids. In one of its aspects, it is directed to compositions comprising an oleaginous liquid of lubricating viscosity and at least one polyfunctional nitrile of the formula

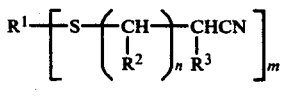

(I)

wherein:

$R^1$ is a monovalent or polyvalent saturated aliphatic radical having about 4–25 carbon atoms;

each $R^2$ is individually hydrogen or a lower hydrocarbon-based radical;

$R^3$ is hydrogen, a lower hydrocarbon-based radical, halogen, CN or $COOR^4$;

$R^4$ is hydrogen or a lower alkyl radical;

m is the valence of $R^1$; and n is an integer from 0 to 2.

In another of its aspects, the invention is directed to lubricant compositions containing a minor amount of a β-thiopropionitrile having the structure $$R—S—CH_2CH_2CN \quad (II)$$

in which R is alkyl, nitriloalkyl, aralkyl, alkaryl, aryl or benzothiazolyl, mercaptothiadiazolyl, $NCCH_2CH_2—Y—(CH_2)_p$ where Y is oxygen or sulfur and p is a whole number from 1 to 20.

The problem of shrinkage of seals, particularly elastomeric seals, in machinery (e.g., automatic transmissions for motor vehicles) upon contact with functional fluids is of considerable importance since such shrinkage causes leakage of the functional fluid which can lead to defective operation of the machinery, or failure to operate at all. (The term "functional fluid", as used herein, means a fluid which is involved in or facilitates the transmission of energy, such as a lubricant, hydraulic fluid, automatic transmission fluid, heat exchange medium or the like.) To eliminate this problem, it is conventional to include in the functional fluid an additive whose presence therein causes the seal to swell. A number of such additives are known in the art, but their use has disadvantages. For example, they must often be used in undesirably large quantities in the functional fluid.

A second problem which is sometimes encountered, especially in gear lubricants, is the formation of water-in-oil emulsions. Such emulsion formation, which impairs the effectiveness of the lubricant, is often aggravated by additives present therein. While it may sometimes be possible to replace these additives, it is also desirable to develop suitable demulsifiers for use with them.

A principal object of the present invention, therefore, is to provide seal-swelling lubricants and functional fluids containing extremely small but effective quantities of seal swelling additives.

Another object is to provide improved lubricants, especially gear lubricants, which resist the formation of water-in-oil emulsions.

Other objects will in part be obvious and will in part appear hereinafter.

As previously noted, the compositions of this invention comprise two components of which the first is an oleaginous liquid of lubricating viscosity. Such liquids include natural and synthetic oils and mixtures thereof, especially oils of the type useful as crnakcase lubricating oils for spark-ignited and compression-ignited internal combustion engines, including automobile and truck engines, two-cycle engines, aviation piston engines, marine and railroad diesel engines, as well as gas engines, stationary power engines and turbines and the like. Base liquids for automatic transmission fluids, transaxle lubricants, gear lubricants, metal-working lubricants, hydraulic fluids and other lubricating oil and grease compositions are also useful for this purpose.

Natural oils include animal oils and vegetable oils (e.g., castor oil, lard oil) as well as liquid petroleum oils and solvent-treated or acid-treated mineral lubricating oils of the paraffinic, naphthenic or mixed paraffinic-naphthenic types; such mineral oils are preferred. Oils of lubricating viscosity derived from coal or shale are also useful.

Synthetic lubricating oils include hydrocarbon oils and halo-substituted hydrocarbon oils such as polymerized and interpolymerized olefins [e.g., polybutylenes, polypropylenes, propylene-isobutylene copolymers, chlorinated polybutylenes, poly(1-hexenes), poly(1-octenes), poly(1-decenes), etc. and mixtures thereof]; alkylbenzenes [e.g., dodecylbenzenes, tetradecylbenzenes, dinonylbenzenes, di-(2-ethylhexyl)benzenes, etc.]; polyphenyls (e.g., biphenyls, terphenyls, alkylated polyphenyls, etc.), alkylated diphenyl ethers and alkylated diphenyl sulfides and the derivatives, analogs and homologs thereof and the like.

Alkylene oxide polymers and interpolymers and derivatives thereof where the terminal hydroxyl groups have been modified by esterification, etherification, etc. constitute another class of known synthetic oils. These are exemplified by the oils prepared through polymerization of ethylene oxide or propylene oxide, the alkyl and aryl ethers of these polyoxyalkylene polymers (e.g., methylpolyisopropylene glycol ether having an average molecular weight of 1000, diphenyl ether of polyethylene glycol having a molecular weight of 500–1000, diethyl ether of polypropylene glycol having a molecular weight of 1000–1500, etc.) or mono- and polycarboxylic esters thereof, for example, the acetic acid esters, mixed $C_3$–$C_8$ fatty acid esters, esters, or the $C_{13}$ Oxo acid diester of tetraethylene glycol.

Another suitable class of synthetic oils comprises the esters of dicarboxylic acids (e.g., phthalic acid, succinic acid, alkyl succinic acids and alkenyl succinic acids, maleic acid, azelaic acid, suberic acid, sebacic acid, fumaric acid, adipic acid, linoleic acid dimer, malonic acid, alkyl malonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoether, propylene glycol, etc.). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethylhexanoic acid, and the like.

Esters useful as synthetic oils also include those made from $C_5$ to $C_{12}$ monocarboxylic acids and polyols and polyol ethers such as neopentyl glycol, trimethylolpropane, pentaerythritol, dipentaerythritol, tripentaerythritol, etc.

Silicon-based oils such as the polyalkyl-, polyaryl-, polyalkoxy-, or polyaryloxy-siloxane oils and silicate oils comprise another useful class of synthetic oils [e.g., tetraethyl silicate, tetraisopropyl silicate, tetra-(2-ethylhexyl) silicate, tetra-(4-methyl-2-ethylhexyl) silicate, tetra-(p-tert-butylphenyl) silicate, hexyl-(4-methyl-2-pentoxy)disiloxane, poly(methyl)siloxanes, poly(methylphenyl)siloxanes, etc.]. Other synthetic oils include liquid esters of phosphorus-containing acids (e.g., tricresyl phosphate, trioctyl phosphate, diethyl ester of decylphosphonic acid, etc.), polymeric tetrahydrofurans and the like.

Unrefined, refined and rerefined oils (and mixtures of each with each other) of the type disclosed hereinabove can be used in the present invention. Unrefined oils are those obtained directly from a natural or synthetic source without further purification treatment. For example, a shale oil obtained directly from retorting operations, a petroleum oil obtained directly from distillation or ester oil obtained directly from an esterification process and used without further treatment would be an unrefined oil. Refined oils are similar to the unrefined oils except they have been further treated in one or more purification steps to improve one or more properties. Many such purification techniques are known to those of skill in the art such as solvent extraction, acid or base extraction, filtration, percolation, etc. Rerefined oils are obtained by processes similar to those used to obtain refined oils applied to refined oils which have been already used in service. Such refined oils are also known as reclaimed or reprocessed oils and often are additionally processed by techniques directed to removal of spent additives and oil breakdown products.

The seal swelling component in the compositions of this invention is at least one polyfunctional nitrile which may be defined by formula I hereinabove. As used in the definition thereof, the term "hydrocarbon-based radical" denotes a radical having a carbon atom directly attached to the remainder of the molecule and having predominantly hydrocarbon character within the context of this invention. Such radicals include the following:

(1) Hydrocarbon radicals; that is, aliphatic, (e.g., alkyl or alkenyl), alicyclic (e.g., cycloalkyl or cycloalkenyl), aromatic, aliphatic- and alicyclic-substituted aromatic, aromatic-substituted aliphatic and alicyclic radicals, and the like. Such radicals are known to those skilled in the art; examples include methyl, ethyl, butyl, pentyl, hexyl, octyl, decyl, dodecyl, eicosyl, decinyl, cyclohexyl, phenyl, tolyl, heptylphenyl, isopropenylphenyl and naphthyl (all isomers of such radicals being included when more than one isomer is possible).

(2) Substituted hydrocarbon radicals; that is, radicals containing non-hydrocarbon substituents which, in the context of this invention, do not alter the predominantly hydrocarbon character of the radical. Those skilled in the art will be aware of suitable substituents; examples are halogen (fluorine, chlorine, bromine, iodine), nitro, cyano.

$$R'O-,\ R'\overset{\overset{O}{\|}}{C}-,\ R'O\overset{\overset{O}{\|}}{C}-,\ R'_2N-,\ R''_2N\overset{\overset{O}{\|}}{C}-,$$

$$R'S-,\ R'\underset{\underset{O}{\|}}{S}-,\ R'\underset{\underset{O}{\|}}{\overset{\overset{O}{\|}}{S}}-\ \text{and}\ R'O\overset{\overset{O}{\|}}{S}-$$

(R′ being a hydrocarbon radical and R″ being hydrogen or a hydrocarbon radical).

(3) Hetero radicals; that is, radicals which, while predominantly hydrocarbon in character within the context of this invention, contain atoms other than carbon present in a chain or ring otherwise composed of carbon atoms. Suitable hetero atoms will be apparent to those skilled in the art and include, for example, oxygen, nitrogen and sulfur.

In general, no more than about three substituents or hetero atoms, and preferably no more than one, will be present for each 10 carbon atoms in the hydrocarbon-based radical.

Preferably, the hydrocarbon-based radicals present as $R^2$ and $R^3$ in the compounds of formula I are free from acetylenic and usually also from ethylenic unsaturation and have about 1–30 carbon atoms, desirably about 1–10 carbon atoms. The radicals are usually hydrocarbon and especially lower hydrocarbon, the word "lower" denoting radicals containing up to seven carbon atoms. They are preferably lower alkyl or aryl radicals, especially lower alkyl. Most often they are hydrogen or lower alkyl (especially methyl), and usually hydrogen.

$R^1$ is a monovalent or polyvalent saturated aliphatic (i.e., aliphatic hydrocarbon-based) radical as defined. It is usually an alkyl or alkylene radical; i.e., a monovalent (e.g., butyl, pentyl, octyl, 2-ethylhexyl, decyl, isodecyl, pentadecyl, eicosyl) or divalent (e.g., butylene, pentylene, tetramethylene or other alkylene radicals analogous to the above alkyl radicals) saturated radical; and it is preferably monovalent.

The integer m is equal to the valence of the $R^1$ radical. Thus, it is usually 1 or 2 and preferably 1. The integer n is 0, 1 or 2 and preferably 1.

As defined by formula II, the useful $\beta$-thiopropionitriles are those in which R may correspond to $R^1$ in formula I or may be one of the other designated radicals. Most often, R contains from 4 to 25 carbon atoms, and it is preferably an alkyl group, especially tetrapropyl (i.e., the radical formed by protonation of tetrapropene) or t-dodecyl.

The compounds of formula I wherein n is 1 and those of formula II are known in the art and may be prepared by cyanoethylation or the like of mercaptans; that is by reaction of mercaptans with acrylonitrile or with analogous nitriles such as methacrylonitrile, $\alpha$-chloroacrylonitrile, crotononitrile or ethyl 2-cyanoacrylate. The cyanoethylation of such compounds is described in Bruson, *Organic Reactions*, 5, 79(1949), which is incorporated by reference herein for such description.

Compounds of formula I in which n is 0 may be prepared by the reaction of cyanohydrins with mercaptans. Those in which n is 2 may be prepared by the reaction of a butyrolactone with a mercaptan to form a $\gamma$-substituted carboxylic acid which may be converted to the corresponding nitrile by known methods.

The compositions of this invention contain a major amount of the oleaginous liquid of lubricating viscosity and a minor amount of polyfunctional nitrile effective to cause swelling of seals in machinery (typically about 0.05–20.0 parts by weight, and preferably about 0.1–5.0 parts, per 100 parts of oil) or to inhibit formation of water-in-oil emulsions (typically about 0.001–10.0 parts and preferably about 0.005–2.0 parts per 100 parts of oil). However, the invention includes additive concentrates comprising said oleaginous liquid or a similar substantially inert, normally liquid organic diluent and the polyfunctional nitrile, the latter typically comprising up to about 90% of the weight of the concentrate and usually about 20–90% thereof. Such concentrates may be further diluted, as is well known in the art, to produce functional fluids.

The present invention also contemplates functional fluids and concentrates containing other additives in combination with the polyfunctional nitrile. Such additives include, for example, detergents and dispersants of the ash-containing or ashless type, corrosion- and oxidation-inhibiting agents, pour point depressing agents, extreme pressure agents, viscosity index improvers, friction modifiers, color stabilizers and anti-foam agents, The ash-containing detergents are exemplified by oil-soluble neutral and basic salts of alkali or alkaline earth metals with sulfonic acids, carboxylic acids, or organic phosphorus acids characterized by at least one direct carbon-to-phosphorus linkage such as those prepared by the treatment of an olefin polymer (e.g., polyisobutene having a molecular weight of 1000) with a phosphorizing agent such as phosphorus trichloride, phosphorus heptasulfide, phosphorus pentasulfide, phosphorus trichloride and sulfur, white phosphorus and a sulfur halide, or phosphorothionic chloride. The most commonly used salts of such acids are those of sodium, potassium, lithium, calcium, magnesium, strontium and barium.

The term "basic salt" is used to designate metal salts wherein the metal is present in stoichiometrically larger amounts than the organic acid radical. The commonly employed methods for preparing the basic salts involve heating a mineral oil solution of an acid with a stoichiometric excess of a metal neutralizing agent such as the metal oxide, hydroxide, carbonate, bicarbonate, or sulfide at a temperature above 50° C. and filtering the resulting mass. The use of a "promoter" in the neutralization step to aid the incorporation of a large excess of metal likewise is known. Examples of compounds useful as the promotor include phenolic substances such as phenol, naphthol, alkylphenol, thiophenol, sulfurized alkylphenol, and condensation products of formaldehyde with a phenolic substance; alcohols such as methanol, 2-propanol, octyl alcohol, cellosolve, carbitol, ethylene glycol, stearyl alcohol, and cyclohexyl alcohol; and amines such as aniline, phenylenediamine, phenothiazine, phenyl-β-naphthylamine, and dodecylamine. A particularly effective method for preparing the basic salts comprises mixing an acid with an excess of a basic alkaline earth metal neutralizing agent and at least one alcohol promoter, and carbonating the mixture at an elevated temperature such as 60°–200° C.

Ashless detergents and dispersants are illustrated by the interpolymers of an oil-solubilizing monomer, e.g., decyl methacrylate, vinyl decyl ether, or high molecular weight olefin, with a monomer containing polar substituents, e.g., aminoalkyl acrylate or poly-(oxyethylene)-substituted acrylate; the amine salts, amides, and imides of oil-soluble monocarboxylic or dicarboxylic acids such as stearic acid, oleic acid, tall oil acid, and high molecular weight alkyl or alkenyl-substituted succinic acid. Especially useful as ashless detergents are the acylated polyamines and similar nitrogen compounds containing at least about 54 carbon atoms as described in U.S. Pat. No. 3,272,746; reaction products of such compounds with other reagents including boron compounds, phosphorus compounds, epoxides, aldehydes, organic acids and the like; and esters of hydrocarbon-substituted succinic acids as described in U.S. Pat. No. 3,381,022.

Extreme pressure agents and corrosion-inhibiting and oxidation-inhibiting agents are exemplified by chlorinated aliphatic hydrocarbons such as chlorinated wax; organic sulfides and polysulfides such as benzyl disulfide, bis(chlorobenzyl) disulfide, dibutyl tetrasulfide, sulfurized methyl ester of oleic acid, sulfurized alkylphenol, sulfurized dipentene, and sulfurized terpene; phosphosulfurized hydrocarbons such as the reaction product of a phosphorus sulfide with turpentine or methyl oleate; phosphorus esters including principally dihydrocarbon and trihydrocarbon phosphites such as dibutyl phosphite, diheptyl phosphite, dicyclohexyl phosphite, pentyl phenyl phosphite, dipentyl phenyl phosphite, tridecyl phosphite, distearyl phosphite, dimethyl naphthyl phosphite, oleyl 4-pentylphenyl phosphite, polypropylene (molecular weight 500)-substituted phenyl phosphite, diisobutyl-substituted phenyl phosphite; metal thiocarbamates, such as zinc dioctyldithiocarbamate, and barium heptylphenyl dithiocarbamate; Group II metal phosphorodithioates such as zinc dicyclohexylphosphorodithioate, zinc dioctylphosphorodithioate, barium di(heptylphenyl)phosphorodithioate, cadmium dinonylphosphorodithioate, and the zinc salt of a phosphorodithioic acid produced by the reaction of phosphorus pentasulfide with an equimolar mixture of isopropyl alcohol and n-hexyl alcohol.

A typical composition according to this invention is constituted as follows, all parts being by weight:

| | |
|---|---|
| Mineral oil (SAE 90 base) | 96.09 |
| β-(Tetrapropylthio)propionitrile or β-(t-dodecylthio)propionitrile | 0.005 |
| Amine-neutralized reaction product of phosphorus pentoxide and hydroxypropyl dialkylphosphorodithioate | 0.29 |
| N-tallow diaminopropane | 0.05 |
| Sulfurized isobutene | 1.26 |
| Sulfurized fatty oil-fatty acid mixture | 2.29 |
| Silicone anti-foam agent | 0.02 |

What is claimed is:

1. A composition comprising an oleaginous liquid of lubricating viscosity and about 0.001–20.0 parts by weight, per 100 parts of said oleaginous liquid, of at least one polyfunctional nitrile of the formula

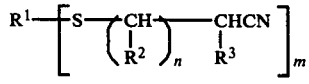

wherein $R^1$ is a monovalent or polyvalent saturated aliphatic hydrocarbon radical having about 4–25 carbon atoms;

each $R^2$ is individually hydrogen or a lower hydrocarbon-based radical;

$R^3$ is hydrogen, a lower hydrocarbon-based radical, halogen, CN or $COOR^4$;

$R^4$ is hydrogen or a lower alkyl radical;

m is the valence of $R^1$; and n is an integer from 0 to 2.

2. A composition according to claim 1 wherein said polyfunctional nitrile is present in a minor amount effective to cause swelling of seals in machinery or to inhibit formation of water-in-oil emulsions.

3. A composition according to claim 2 wherein $R^2$ and $R^3$ are each hydrogen, m is 1 or 2, and n is 1.

4. A composition according to claim 3 wherein $R^1$ is an alkyl radical and m is 1.

5. A composition according to claim 4 wherein the oleaginous liquid is a mineral oil.

6. A composition according to claim 5 wherein $R^1$ is the tetrapropyl or t-dodecyl radical.

7. A composition according to claim 4 wherein the oleaginous liquid is a synthetic oil.

8. A composition according to claim 7 wherein $R^1$ is the tetrapropyl or t-dodecyl radical.

9. A composition according to claim 1 which comprises an additive concentrate containing said polyfunctional nitrile in an amount up to about 90% by weight.

10. A composition according to claim 9 wherein $R^2$ and $R^3$ are each hydrogen, m is 1 or 2, and n is 1.

11. A composition according to claim 10 wherein $R^1$ is an alkyl radical and m is 1.

12. A composition according to claim 11 wherein the oleaginous liquid is a mineral oil.

13. A composition according to claim 12 wherein $R^1$ is the tetrapropyl or t-dodecyl radical.

14. A composition according to claim 13 wherein the oleaginous liquid is a synthetic oil.

15. A composition according to claim 14 wherein $R^1$ is the tetrapropyl or t-dodecyl radical.

16. A lubricant composition containing a seal swelling or emulsion suppressing amount of a $\beta$-thiopropionitrile having the structure $R—S—CH_2CH_2CN$ in which R is alkyl, nitrilalkyl, aralkyl, alkaryl, aryl or benzothiazolyl, mercaptothiadiazolyl, $NCCH_2CH_2—Y—(CH_2)_p$ where Y is oxygen or sulfur and p is a whole number from 1 to 20.

17. The lubricant composition defined in claim 16 wherein the alkyl, nitriloalkyl, alkaryl and aralkyl groups contain from 4 to 25 carbon atoms.

18. The lubricant composition defined in claim 16 wherein said lubricant comprises a mineral oil.

19. The lubricant composition defined in claim 16 wherein said lubricant comprises a synthetic oil.

20. A method of causing swelling of seals in machinery which comprises contacting said seals with a solution in an oleaginous liquid of lubricating viscosity of at least one polyfunctional nitrile of the formula

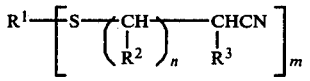

wherein $R^1$ is a monovalent or polyvalent saturated aliphatic hydrocarbon radical having about 4–25 carbon atoms;

each $R^1$ is individually hydrogen or a lower hydrocarbon-based radical;

$R^3$ is hydrogen, a lower hydrocarbon-based radical, halogen, CN or $COOR^4$;

$R^4$ is hydrogen or a lower alkyl radical;

m is the valence of $R^1$; and n is an integer from 0 to 2.

21. A method according to claim 20 wherein $R^2$ and $R^3$ are each hydrogen, m is 1 or 2, and n is 1.

22. A method according to claim 21 wherein $R^1$ is an alkyl radical and m is 1.

23. A method according to claim 22 wherein the oleaginous liquid is a mineral oil.

24. A method according to claim 23 wherein $R^1$ is the tetrapropyl or t-dodecyl radical.

25. A method according to claim 22 wherein the oleaginous liquid is a synthetic oil.

26. A method according to claim 25 wherein $R^1$ is the tetrapropyl or t-dodecyl radical.

27. The lubricant composition defined in claim 16 wherein the $\beta$-thiopropionitrile is present in an amount from about 0.1 to about 5 parts by weight per 100 parts of oil.

* * * * *

UNITED STATES PATENT AND TRADEMARK OFFICE

CERTIFICATE OF CORRECTION

PATENT NO. : 4,209,408

DATED : June 24, 1980

INVENTOR(S) : Donald Irvin Hoke

It is certified that error appears in the above–identified patent and that said Letters Patent are hereby corrected as shown below:

Column 8, line 22, "$R^1$" should read --$R^2$--.

Signed and Sealed this

*Twenty-third* Day of *September 1980*

[SEAL]

*Attest:*

SIDNEY A. DIAMOND

*Attesting Officer*

*Commissioner of Patents and Trademarks*